United States Patent [19]

Dennis

[11] Patent Number: 4,619,044

[45] Date of Patent: Oct. 28, 1986

[54] APPARATUS TO AID IN PRECISION HAIRCUTTING

[76] Inventor: Robert A. Dennis, 103 N. DeVilliers, Pensacola, Fla. 32501

[21] Appl. No.: 638,903

[22] Filed: Aug. 8, 1984

[51] Int. Cl.[4] ..... B26B 19/20; B26B 19/44

[52] U.S. Cl. ..... 30/133; 132/45 R; 132/1

[58] Field of Search ..... 30/133, 131; 132/45 R, 132/1

[56] References Cited

U.S. PATENT DOCUMENTS 4,000,562 1/1977 Alevras ..... 30/133

4,473,945 10/1984 Nagol ..... 30/133

*Primary Examiner*—Robert Peshock

[57] ABSTRACT

An apparatus to aid in the cutting of hair used in combination with a source of suction and a hair cutting means comprising an elongated cylindrical open-ended member having a bore longitudinally therethrough, the first end portion of the member being of an enlarged diameter of the bore and adapted to abut the scalp of the head of hair to be cut, and the second end portion of the member adapted to be connected to a source of suction, a plurality of radially spaced inlet ports provided through the first end of the member for permitting the entry of air into the member when the first end portion abuts the scalp and is provided with a source of suction thereby allowing the force of the suction to entrain hair longitudinally of the bore, a plurality of longitudinally spaced openings provided in the member intermediate its ends for selectively introducing hair cutters into the member for cutting hair entrained longitudinally of the bore, and a plurality of rings slidably mounted on the member for selectively sealing all but one of the openings in the member while the source of suction is applied to thereby increase the force of suction.

11 Claims, 6 Drawing Figures

FIG. 1

APPARATUS TO AID IN PRECISION HAIRCUTTING

BACKGROUND OF THE INVENTION

The subject matter of this application was filed in the U.S. Patent and Trademark Office under the Disclosure Document Program on Feb. 24, 1984, and bears Disclosure Document No. 124,883.

1. Field of the Invention

The present invention relates to an apparatus to aid in the precision cutting of hair. More particularly, the present invention relates to an apparatus to aid in the precision cutting of hair in combination with a source of suction and haircutting means.

2. General Background

All past societies have been very conscious of grooming standards, but today's modern society is especially conscious, and, with this consciousness has developed an industry on which millions of dollars are spent annually. A typically standard haircut can be very expensive. Thus a need is developed to provide the public, particularly the male population, with an alternative to the expense of a professional haircut yet provide a precision haircut.

Scissors, shears, and razors are well-known devices to produce a male haircut; however, the use of these by an untrained individual can result in a less than satisfactory cut and even require a trip to the barber for corrective action. This inventor knows of no devices to aid the non-professional in providing a precision haircut to either himself or to another.

In cutting the hair of males it is a generally accepted myth that the individual hairs should be cut at different lengths to "layer" the remaining hair. However, this is not so for males as each hair should be cut to the same length and it will then naturally posture itself upon the scalp—thus the need for the present invention.

GENERAL DISCUSSION OF THE PRESENT INVENTION

The present invention provides an apparatus to aid in the precision cutting of hair, particularly though not exclusively for males, by insuring that each hair is cut to the same length.

The present invention provides an apparatus to aid in the precision cutting of hair used in combination with a source of suction and hair cutting means.

The present invention provides an elongated cylindrical open-ended member having a bore therethrough and a first end portion having an enlarged diameter of the bore and adapted to abut the scalp of the head of hair to be cut, and a second end portion adapted to be connected to a source of suction.

A plurality of spaced openings or slots provided through the first end portion of the member for permitting the entry of air into the member when it abuts the scalp is provided with a source of suction connected to the other end thereby allowing the force of the suction to entrain hair longitudinally of the bore. A second plurality of longitudinally spaced openings are provided in the member intermediate the ends for introducing a cutting means such as a scissors for cutting the hair entrained longitudinally in the bore. A plurality of seal rings are slidably mounted on the member for sealing all but one of the second plurality of openings or slots in the body of the member while the source of suction is applied to increase the force of suction and thereby improve the entrainment of the hair in the member.

With the apparatus of the present invention, a non-professional can precision cut hair by ensuring that each hair is cut to the same length.

The apparatus of the present invention provides a device for a non-professionals to give a precision hair cut quickly and inexpensively.

It is an object of the present invention to provide an aid to the precision cutting of hair which provides no moving parts and needs only a source of suction and a haircutting means.

Still another object of the present invention is to provide an apparatus to aid in the precision cutting of hair which is easy to operate and to maintain.

BRIEF DESCRIPTION OF THE DRAWINGS

For the further understanding of the nature and objects of the present invention, reference should be had to the following detailed description, taken in conjuction with the accompanying drawing, in which like parts give like reference numerals and wherein.

DETAILED DESCRIPTION OF THE PREFERRED EMBODIMENT

Figure 1:
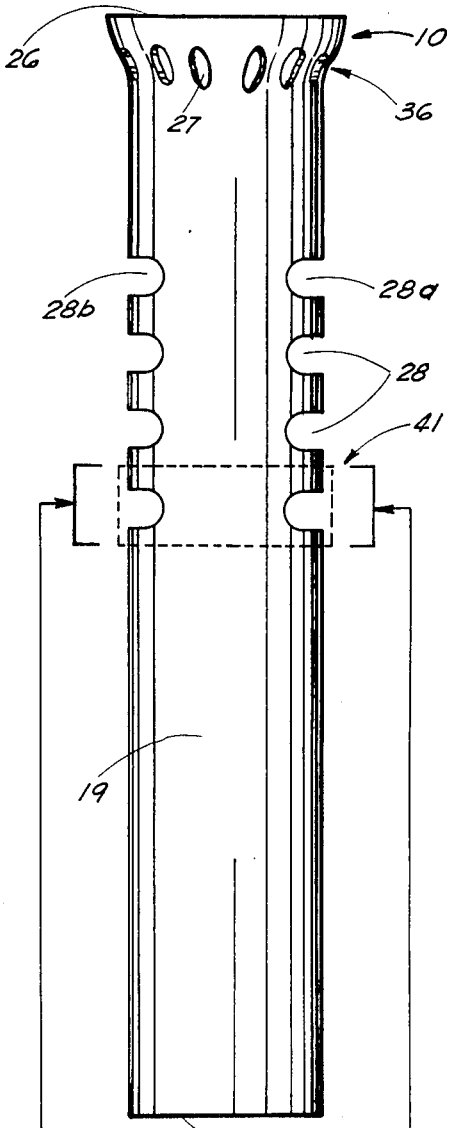
FIG. 1 is a side view of the preferred embodiment of the apparatus of the present invention.

The apparatus of the present invention generally designated by the numeral 10 is best shown in FIG. 1. Haircutting aid apparatus 10 provides an elongated cylindrical or tubular open-ended member or body portion 19 having a bore 21 longitudinally thereof. The first end portion 26 of member 19 is of an enlarged diameter relative to the diameter of bore 21 thus creating neck portion 36 of member 19. The opposite end 20 of member 19 is generally of the uniform diameter of bore 21 and is adapted to be connected to a source of suction (not shown), which may be a commercially available device such as a vacuum cleaner, via a hose (also not shown) or other connecting means. Thus the diameter of bore 21 is such that it would be readily adapted to be connected to a conventional vacuum cleaner hose which provides the source of a suitable force of suction through member 19 from end portion 26 toward end portion 20.

Enlarged neck portion 36 of member 19 is provided with a plurality of radially spaced openings or air inlet ports 27 which permit the entry of air into bore 21 of member 19 when end portion 26 abuts the scalp of the head of hair to be cut (not shown) and is provided with a source of suction (also not shown). Thus openings 27 will allow air to enter member 19 under suction when member 19 it is abutting the scalp of the head of hair to be cut at one end 26 and is connected to the source of suction at the other end 20 to allow the force of the suction to entrain the hair to be cut longitudinally within bore 21.

Figure 4:
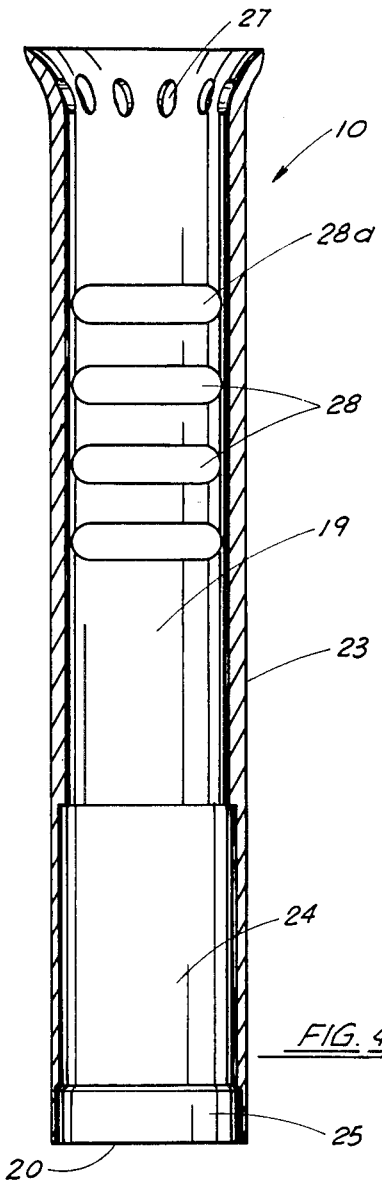
FIG. 4 is a frontal view of an alternate embodiment of the apparatus of the present invention.

A second series of longitudinally spaced openings or slots 28 are provided in member 19 intermediate the two end portions 20, 26 so that a conventional means for cutting hair, such as scissors, can be introduced into bore 21 when hair is entrained therein under the force of suction. As best seen in FIGS. 1 and 4, any pair of slots 28*a*, 28*b* extend over approximately one-half the perimeter of member 19 and are provided in opposing surfaces of member 19 so that as a cutting means such as scissors (not shown) is introduced into bore 21 of member 19 through slot 28*a* it will pass laterally through bore 21 and out of member 19 at the corresponding opening 28*b* formed in the opposite surface. In this manner, lengthy scissors may be employed.

Figure 2:
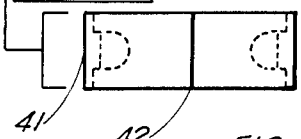
FIG. 2 is a side view of one of the slidable rings of the apparatus of FIG. 1.
Figure 3:
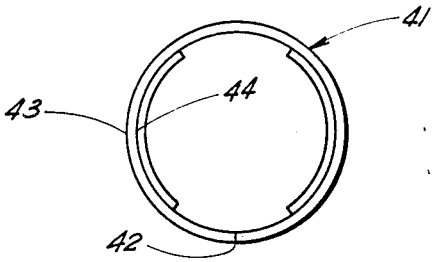
FIG. 3 is an top view of the ring of FIG. 2.

Each pair of slots or openings 28*a*, 28*b* is provided with flexible seal ring 41, best shown in phantom view in FIG. 1, and in side view and in end view in FIGS. 2 and 3. Rings 41 are slidably mounted on member 19 and sealingly engage slots or openings 28 to prevent the loss of suction within member 19. It is to be understood that a plurality of rings 41 will be slidably mounted on member 19 so that there is a ring 41 corresponding to each slot 28. Rings 41 can be selectively positioned along member 19 to cover all but one of slots 28, with that open slot then being employed for the introduction of scissors or other means for the cutting of hair entrained within member 19 as described further hereinbelow.

Ring 41, as best seen in FIGS. 2 and 3, is comprised of a primary ring member 43 having a split 42 therein so that ring 41 can be easily and flexibly provided on or removed from the exterior of member 19. Ring 41 is further provided with a pair of interior elements 44 fixedly secured to the interior surface of primary ring member 43 which occupy approximately one-half of the interior perimeter of primary ring member 43 and is further of a longitudinal and arcuate distance equal to that of slots 28 provided in housing member 19. In this manner when ring member 41 is properly mounted on the exterior of member 19, interior ring elements 44 will mate with slots or openings 28 in member 19 and effectively preclude the passage of air from the exterior member 19 to bore 21 while under a source of suction thus increasing the efficiency of the suction provided interior of member 19 for entraining the hair to be cut in bore 21.

In operation, all but one of the several pairs of slots 28 and member 19 are provided with ring members 41 to provide a seal with the atmosphere. The unsealed pair of slots 28 will correspond with the desired hair length. Then a source of suction, such as a commercially available vacuum cleaner (not shown), is connected to member 19 at end portion 20. A source of suction having been provided, end portion 26 of member 19 is placed on the scalp of the individual whose hair is to be cut such that the interior surface 31 of neck portion 36 abuts the scalp and the individual's hair will then become entrained longitudinally of bore 21 because of the force created by the source of suction and openings 27 provided in enlarged neck portion 36 of member 19. With the hair to be cut entrained longitudinally of bore 21 of member 19, a cutting apparatus such as a commercially available scissors (not shown) is inserted into slot 28*a* laterally through bore 21 exiting at slot 28*b* and cutting action can take place in bore 21 of member 19. It can be readily appreciated from FIGS. 1–4 that the length of the cut accomplished on the hair can be varied by selecting a pair of slots 28*a*, 28*b* anywhere along the length of member 19. In the preferred embodiment, four such pairs of slots 28 are illustrated but it can be readily understood that the number and spacing of such slots 28 can be varied depending on the hair styles in vogue.

Figure 5:
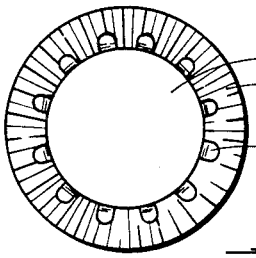
FIG. 5 is a top view of the apparatus of FIG. 4.
Figure 6:
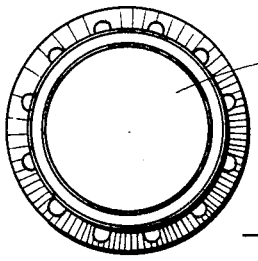
FIG. 6 is a bottom view of the apparatus of FIG. 4.

In FIGS. 4–6, an alternate embodiment of the apparatus of the present invention is illustrated which provides for additional enlarged bore sections 24, 25 in lower portion 20 of member 19 so that various size vacuum hoses (not shown) can be secured in end portion 20; collar 23 can be provided as a gripping surface.

A further embodiment of the apparatus of the present invention can provide for curved cylindrical member 19, wherein the end portions 20, 26 are provided in perpendicular relation with the curvature of member 19 provided below the lowermost of slots 28 yet near the mid-point of member 19. This curved cylindrical member design thus allows the apparatus to be "pistol" gripped by the user and thus more easily manipulated during operation.

Because many varying and different embodiments may be made within the scope of the inventive concept herein taught, and because many modifications may be made in the embodiments herein detailed in accordance with the discriptive requirement of the law, it is to be understood that the details herein are to be interpreted as illustrative and not in a limiting sense.

What is claimed as invention is:

1. An apparatus to aid in the cutting of hair used in combination with the sorce of suction and haircutting means comprising;

a. an elongated cylindrical open-ended member having a bore longitudinally therethrough, the first end portion thereof adapted to abut the scalp of the head of hair to be cut, and the second end portion thereof adapted to communicate with said source of suction;

b. a plurality of spaced inlet ports provided in said first end portion of said member for permitting the entry of air into said member when said first end portion of said member abuts said scalp and said second end portion of said member is provided with a source of suction thereby allowing the force of said suction to entrain said hair longitudinally of said bore;

c. a plurality of longitudinally spaced openings provided in said member intermediate said end portions for selectively introducing into said member means for cutting said hair entrained longitudinally of said bore; and d. a plurality of means slidably mounted on said member for selectively sealing all but one of said plurality of longitudinally spaced openings in said member while said source of suction is applied, wherein said means for selectively sealing said longitudinally spaced openings include a split ring having protrusions depending from its internal perimeter for engaging said openings of said member when said means is mounted on said member.

2. The apparatus of claim 1 wherein said first end portion of said member is of an enlarged diameter of said bore.

3. The apparatus of claim 1 wherein said inlet ports are radially spaced in said first end portion.

4. The apparatus of claim 1 wherein said plurality of longitudinal spaced openings in said member extend circumferentially over approximately one-fourth of the circumference of said cylindrical member and are provided in laterally opposing pairs on opposing surfaces of said member.

5. The apparatus of claim 1 wherein said cylindrical member is curved intermediate said end portions.

6. The apparatus of claim 5 wherein said curvature is substantially 90°.

7. The apparatus of claim 5 wherein said curvature is provided intermediate said second end portion and said longitudinally spaced openings.

8. An apparatus to aid in the cutting of hair used in combination with a source of suction and haircutting means comprising:

a. an elongated cylindrical open-ended member having a bore longitudinally therethrough, the first end portion thereof being of an enlarged diameter of said bore and adapted to abut the scalp of the head of hair to be cut, and the second end portion thereof adapted to communicate with said source of suction;

b. a plurality of radially spaced inlet ports provided in said first end portion of said member for permitting the entry of air into said member when said first end portion of said member abuts said scalp and said second end portion of said member is provided with a source of suction thereby allowing the force of said suction to entrain said hair longitudinally of said bore;

c. a plurality of longitudinally spaced openings provided in said member intermediate said end portion for selectively introducing into said member means for cutting said hair entrained longitudinally of said bore; and d. a plurality of means slidably mounted on said member for selectively sealing all but one of said plurality of longitudinally spaced openings in said member while said source of suction is applied, wherein said means for selectively sealing said longitudinally spaced openings include a split ring having protrusions depending from its internal perimeter for engaging said openings of said member when said means is mounted on said member.

9. The apparatus of claim 8 wherein said cylindrical member is curved intermediate said end portions.

10. The apparatus of claim 9 wherein said curvature is substantially 90°.

11. The apparatus of claim 9 wherein said curvature is provided intermediate said second end portion and said longitudinally spaced openings.

* * * * *